US006077147A

United States Patent [19]

Yang et al.

[11] Patent Number: 6,077,147

[45] Date of Patent: Jun. 20, 2000

[54] CHEMICAL-MECHANICAL POLISHING STATION WITH END-POINT MONITORING DEVICE

[75] Inventors: Ming-Sheng Yang, Hsinchu; Hsueh-Chung Chen, Taipei Hsien; Tsang-Jung Lin, Chungli; Juan-Yuan Wu, Hsinchu, all of Taiwan

[73] Assignee: United Microelectronics Corporation, Taiwan

[21] Appl. No.: 09/336,552

[22] Filed: Jun. 19, 1999

[51] Int. Cl.[7] ..... B24B 49/12; B24B 7/22

[52] U.S. Cl. ..... 451/6; 451/288

[58] Field of Search ..... 451/6, 287, 288, 451/41

[56] References Cited

U.S. PATENT DOCUMENTS 5,643,048 7/1997 Iyer ..... 451/6

5,836,805 11/1998 Obeng ..... 451/41

5,851,136 12/1998 Lee ..... 451/6

FOREIGN PATENT DOCUMENTS 357001654 1/1982 Japan ..... 451/288

*Primary Examiner*—Robert A. Rose

*Attorney, Agent, or Firm*—Martine Penilla & Kim, LLP

[57] ABSTRACT

A chemical-mechanical polishing station for polishing wafers. The polishing station comprises a slurry supplier, a polishing pad capable of collecting the slurry, and a polishing head capable of rotating a wafer and lowering the wafer onto the polishing pad in contact with the polishing pad and the slurry during a polishing session. The polishing head further includes a retaining ring for positioning the wafer. The retaining ring houses a light-emitting device capable of shining a beam of light onto the slurry and a light sensor for picking up the beam of light reflected back from the slurry. The exact polishing end-point can be decided by analyzing signals obtained from the light sensor.

10 Claims, 3 Drawing Sheets

CHEMICAL-MECHANICAL POLISHING STATION WITH END-POINT MONITORING DEVICE

BACKGROUND OF THE INVENTION

1. Field of Invention

The present invention relates to a chemical-mechanical polishing (CMP) station. More particularly, the present invention relates to a chemical-mechanical polishing station having a device for monitoring the progress of a wafer polishing operation and facilitating the determination of a polishing end-point.

2. Description of Related Art

Semiconductor fabrication has reached the deep submicron stage. In the deep submicron stage, the feature size and the depth of focus of photolithographic equipment are reduced, and the number of multi-level metal interconnect layers is increased. Consequently, how to maintain a high degree of surface planarity for a wafer becomes a major topic of investigation.

Before the deep submicron era of semiconductor production, spin-on-glass used to be the principle method of planarizing a silicon wafer. However, the method can obtain moderate planarity only in local areas on the wafer surface. Without a global planarization of the wafer surface, quality of development after photographic exposure is poor and the etching end-point is difficult to determine. Hence, yield of wafers is low.

Chemical-mechanical polishing is now the principle means of globally planarizing a silicon wafer, especially in the process of forming deep submicron circuits that have a feature size smaller than 0.18 $\mu$m. In addition, copper has gradually replaced aluminum as the material for forming conductive lines inside a wafer in a so-called damascene process. Since copper is difficult to remove with a common etchant, a chemical-mechanical polishing operation must be used instead.

FIG. 1 is a sketch of the components of a conventional chemical-mechanical polishing station for polishing wafer. As shown in FIG. 1, a wafer 18 is held firmly inside the retaining ring 16*a* of a polishing head 16. The polishing head 16 provides the rotation necessary for polishing as well as the means to lower the wafer 18 onto a polishing table having a polishing pad 10 that rotates in a direction opposite to that of polishing head 16. A slurry supplier 12 is also mounted above the polishing pad 10 to provide slurry 14 for carrying out the polishing action. The slurry 14 contains some polishing agents; among them are included particles of metallic oxide that provide abrasive action necessary for polishing the wafer 18. To prevent over-polishing of the wafer 18, the polishing head 16 is lifted from the polishing pad 10 after a predetermined time interval.

However, due to the unrepeatable amounts of the ingredients within the slurry and conditions of the polishing pad 10 as well as the unpredictability of the wafer surface, appropriate parameter settings are difficult to decide beforehand. Consequently, either too much or too little metal atop a dielectric layer is removed in a damascene process. When too much metal is removed, it causes metal pattern dishing and erosion during over-polishing, and the electrical properties suffer. When too much metal is removed on the wafer surface, it causes a metal bridge effect, and the wafer yield suffers.

SUMMARY OF THE INVENTION

Accordingly, the purpose of the present invention is to provide a device capable of monitoring the progress of a chemical-mechanical polishing operation so that the extent of removal of a metallic layer above a dielectric layer can be estimated. Hence, the end-point for stopping the polishing action can be determined.

To achieve these and other advantages and in accordance with the purpose of the invention, as embodied and broadly described herein, the invention provides a chemical-mechanical polishing station for polishing wafers. The polishing station comprises a slurry supplier for delivering slurry, a polishing pad capable of collecting the slurry, and a polishing head capable of rotating a wafer and lowering the wafer onto the polishing pad in contact with the polishing pad and the slurry during a polishing session. The polishing head further includes a retaining ring for positioning the wafer. The retaining ring also has a groove housing a light-emitting device for emitting a beam of light onto the slurry and a light sensor for picking up the light reflected back from the slurry. The chemical-mechanical polishing station of this invention further includes a monitor and a spectrum analyzer. Both the monitor and the spectrum analyzer are coupled to the light sensor. The spectrum analyzer is used for analyzing any color changes in the slurry and the monitor is used for displaying data about the color changes in the slurry to the user.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
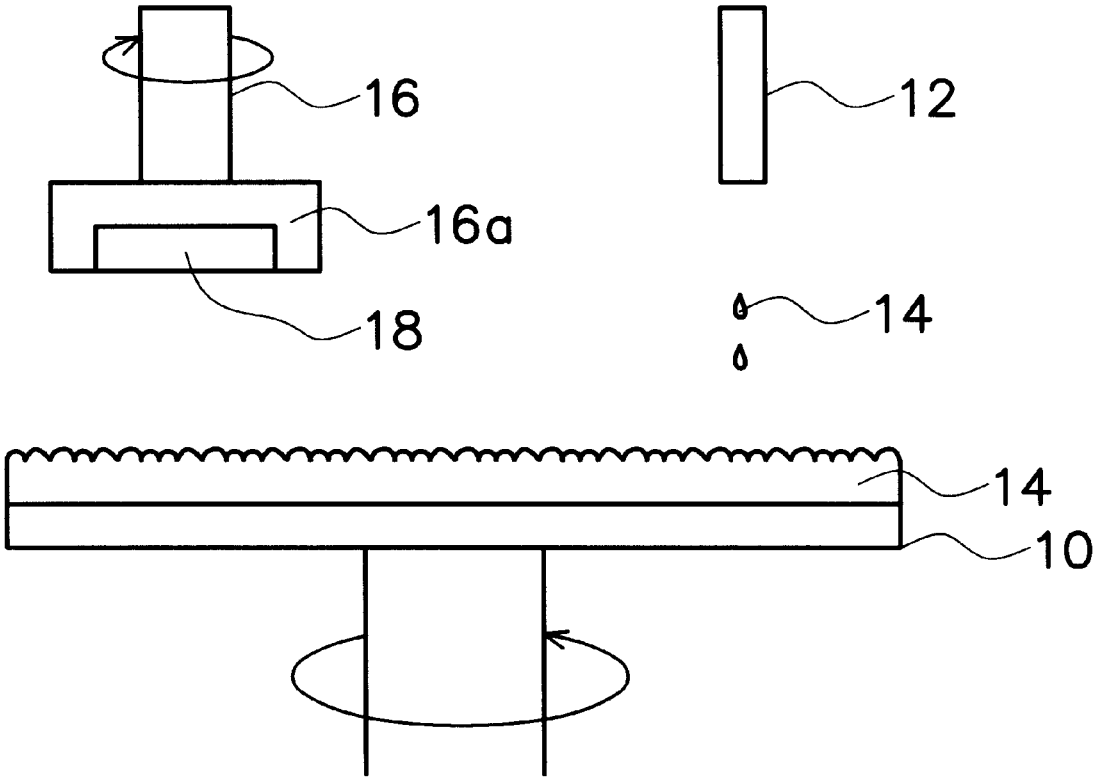
FIG. 1 (PRIOR ART)
FIG. 1 is a sketch of the components of a conventional chemical-mechanical polishing station for polishing a wafer.

Reference will now be made in detail to the present preferred embodiments of the invention, examples of which are illustrated in the accompanying drawings. Wherever possible, the same reference numbers are used in the drawings and the description to refer to the same or like parts.

Figure 2:
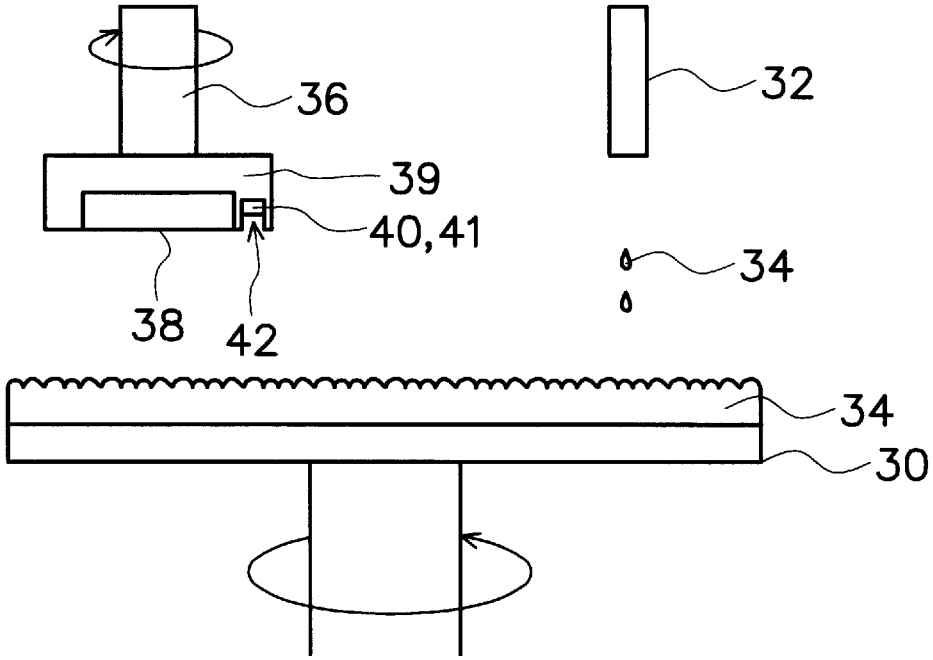
FIG. 2 is a sketch of the components used in a chemical-mechanical polishing station according to the embodiment of this invention.
Figure 3:
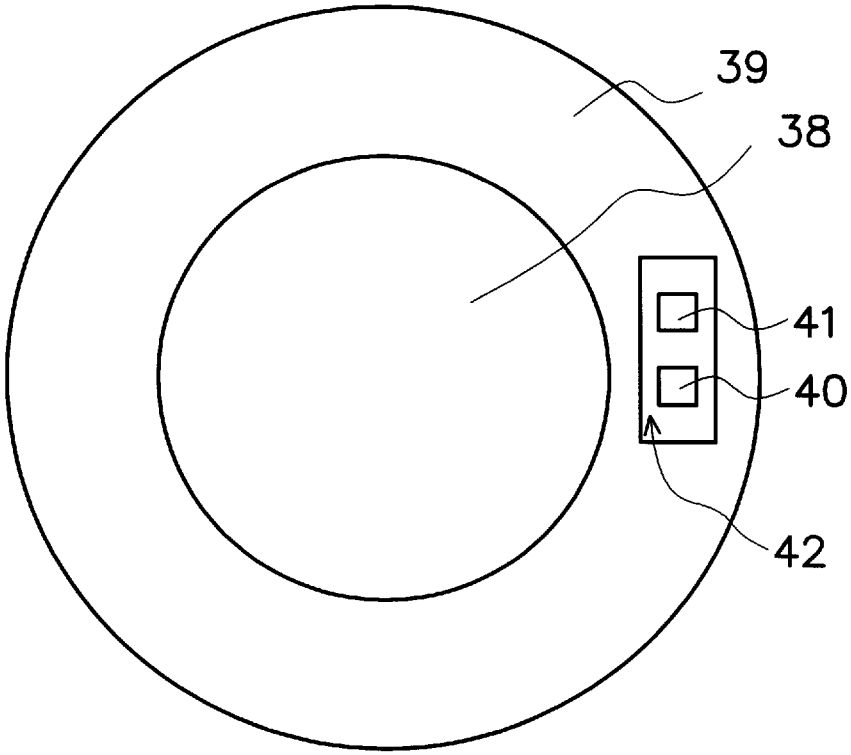
FIG. 3 is a schematic bottom view of the polishing head shown in FIG. 2.

FIG. 2 is a sketch of the components used in a chemical-mechanical polishing station according to the embodiment of this invention. FIG. 3 is a schematic, bottom view of the polishing head shown in FIG. 2.

As shown in FIGS. 2 and 3, a wafer 38 is held firmly inside the retaining ring 39 of a polishing head 36. The retaining ring 39 further has a groove 42 between its rims. The polishing head 36 provides a means of rotating the wafer 38 as well as a way to lower the wafer 38 onto a polishing pad 30. The polishing pad 30 rotates in a direction opposite to that of the polishing head 36. During a polishing session, slurry 34 is also delivered to the surface of the polishing pad 30 through a slurry supplier 32 mounted somewhere above the polishing table. A light-emitting device 40 and a light sensor 41 are installed inside the groove 42 of the retaining ring 39 as well.

Figure 4:
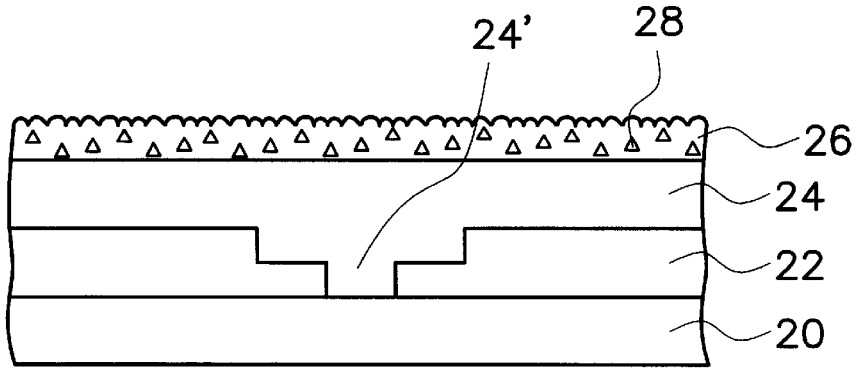
FIG. 4 is a schematic cross-sectional view of a silicon wafer at the beginning of a metallic layer polishing operation in a damascene process.
Figure 5:
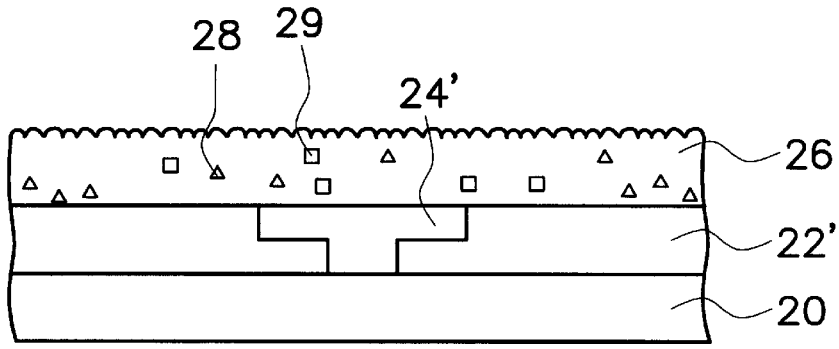
FIG. 5 is a schematic cross-sectional view of a silicon wafer near the end of a metallic layer polishing operation in a damascene process.

FIG. 4 is a schematic, cross-sectional view of a silicon wafer at the beginning of a metallic layer polishing operation in a damascene process. FIG. 5 is a cross-sectional view of a silicon wafer near the end of a metallic layer polishing operation in a damascene process. As shown in FIG. 4, slurry 26 that contains a host of polishing agents abrades a metal, most probably copper, in a metallic layer 24 at the beginning of the chemical-mechanical polishing operation so that metallic particles are created. The metallic particles are carried away by the slurry 26. These small metallic particles also react with some of the polishing agents inside the slurry to form by-products 28. The resulting by-products change the color of the slurry 26. The color change is so obvious that such change can be observed by the naked eyes or a light-sensing device.

As soon as most of the metal in the metallic layer 24 is removed, some of the material in the underlying dielectric layer 22 is polished next. The polished particles from the dielectric layer again react with some of the ingredients of the slurry 26 and result in other kinds of by-products 29. The by-products 29 in the slurry 26 cause yet another change in the color of the slurry 26. The mixture of by-products 29 produces a color that differs from the mixture of by-products 28. Similarly, the color change can be observed by the naked eye or a light-sensing device.

Figure 6:
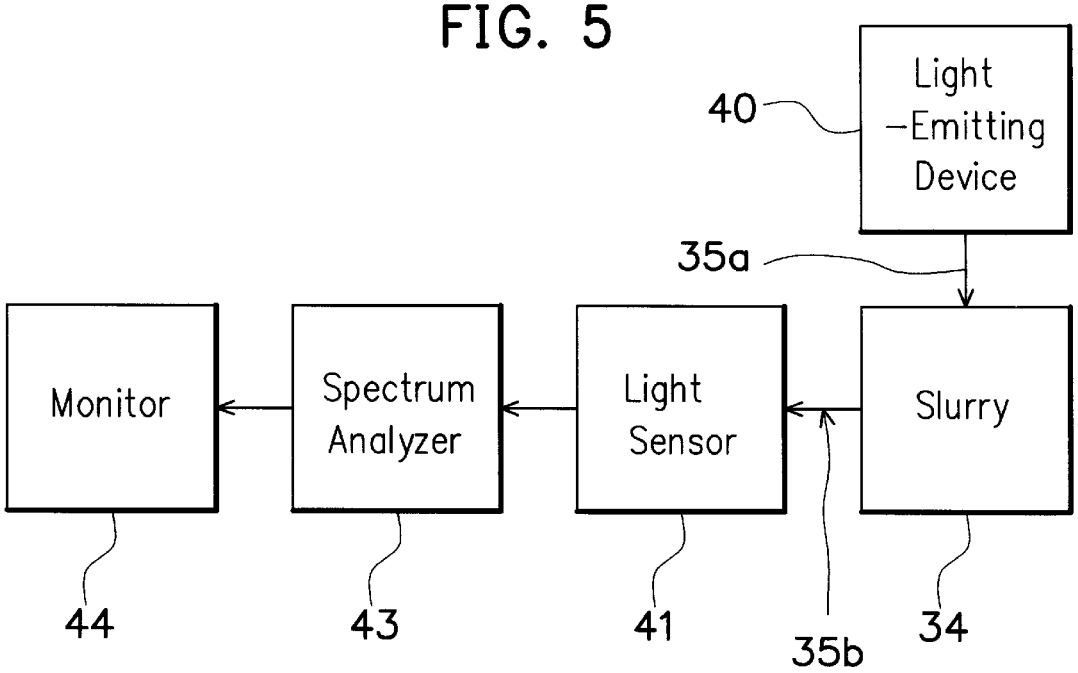
FIG. 6 is a flow chart showing the operational sequence of the polishing end-point monitor of this invention.

FIG. 6 is a flow chart showing the operational sequence of the polishing end-point monitor of this invention. The light-emitting device 40 inside the retaining ring 39 is able to send out a beam of light 35*a* to the slurry 34. The light beam 35*a* shines onto the slurry and forms a reflected beam 35*b* back onto the light sensor 41. Since both the light-emitting device 40 and the light sensor 41 are housed within the groove 42 of the retaining ring 39, they are protected from the scratching action of the slurry 34 on the polishing pad 30.

The light sensor 41 can be further coupled to a spectrum analyzer 43 and a monitor 44. Through the spectrum analyzer 43, the reflected beam 35*b* from the slurry 34 can be analyzed and the resulting data fed into a monitor 44.

As the wafer is continually polished by the polishing station, the ratio of the amount of by-products 29 to by-products 28 increases gradually. This results from a gradual disappearance of the metallic layer 24 and the gradual exposure of the dielectric layer 22 below. Because by-products 29 in the slurry have a color that differs from the same slurry mixed with by-products 28, the color of the slurry 34 changes gradually. Hence, the wavelength of light 35*a* reflected back from the slurry and analyzed by the spectrum analyzer 43 changes gradually with time.

Data that results from analyzing the reflected light 35*a* is fed into the monitor 44. By observing the changes on the monitor 44, a user can determine the progress of the polishing operation and stop the polishing operation in time to obtain an optimal surface finish.

In summary, although factors such as slurry ingredients, rotating speed of polishing or initial conditions of the wafer are all different in each polishing operation, there is no need to optimize each setting individually. Since color changes in the slurry are constantly analyzed by a spectrum analyzer and fed back from a monitor, the exact polishing end-point can be determined quite easily. Hence, over-polishing or under-polishing of a wafer can be entirely avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical-mechanical polishing station for polishing a wafer in damascene process, comprising:

a slurry supplier for delivering slurry;

a polishing pad for collecting the slurry;

a polishing head for holding and rotating the wafer as well as lowering the wafer down so that contact is made with the slurry and the polishing pad during a polishing session, the polishing head further including a retaining ring for positioning the wafer;

a light-emitting device installed inside the retaining ring such that the light-emitting device is able to send out a beam of light onto the slurry;

a light sensor installed inside the retaining ring such that the light sensor is able to receive the beam of light reflected back from the slurry; and a spectrum analyzer coupled to the light sensor for analyzing any color change in the slurry.

2. The chemical-mechanical polishing station of claim 1, wherein the damascene process includes polishing embedded copper lines in the wafer.

3. The chemical-mechanical polishing station of claim 1, wherein the retaining ring has a groove for housing the light-emitting device and the light sensor.

4. The chemical-mechanical polishing station of claim 1, wherein the station further includes a monitor that couples with the light sensor for observing color changes in the slurry.

5. A chemical-mechanical polishing station for planarizing wafers that have embedded copper lines in a damascene process, comprising:

a slurry supplier for delivering slurry;

a polishing pad for collecting the slurry;

a polishing head for holding and rotating the wafer as well as lowering the wafer down so that contact is made with the slurry and the polishing pad during a polishing session, the polishing head further including a retaining ring for positioning the wafer and the retaining ring containing a groove;

a light-emitting device installed inside the groove for emitting a light beam onto the slurry;

a light sensor installed inside the groove for picking up the beam of light reflected back from the slurry;

a spectrum analyzer coupled to the light sensor for analyzing any change of color in the slurry; and a monitor coupled to the spectrum analyzer for observing color changes in the slurry.

6. A chemical-mechanical polishing station for polishing wafers in damascene process, comprising:

a slurry supplier for delivering slurry;

a retaining ring for positioning the wafer;

a light-emitting device installed inside the retaining ring for emitting a light beam to the slurry;

a light sensor installed inside the retaining ring for picking up the light beam reflected back from the slurry; and a spectrum analyzer coupled to the light sensor for analyzing any color changes in the slurry.

7. The chemical-mechanical polishing station of claim 6, wherein the damascene process includes polishing embedded copper lines in the wafer.

8. The chemical-mechanical polishing station of claim 6, wherein the retaining ring has a groove for housing the light-emitting device and the light sensor.

9. The chemical-mechanical polishing station of claim 6, wherein the station further includes a monitor that couples with the light sensor for observing color changes in the slurry.

10. A chemical-mechanical polishing station for planarizing wafers that have embedded copper lines in a damascene process, comprising:

a slurry supplier for delivering slurry;

a retaining ring for positioning the wafer, and the retaining ring further containing a groove between its rims;

a light-emitting device installed inside the groove for emitting alight beam onto the slurry;

a light sensor installed inside the groove for picking up the beam of light reflected back from the slurry;

a spectrum analyzer coupled to the light sensor for analyzing any change of color in the slurry; and a monitor coupled to the spectrum analyzer for observing color changes in the slurry.

* * * * *